United States Patent [19]

Nagy et al.

[11] Patent Number: 4,614,540

[45] Date of Patent: Sep. 30, 1986

[54] PROCESS FOR THE REMOVAL OF CONTAMINATING ELEMENTS FROM PIG-IRON, STEEL, OTHER METALS AND METAL ALLOYS

[75] Inventors: Sándor Nagy; József Mészáros; Ákos Bán; János Horváth; András Pethes, all of Budapest; Lajos Schottner, Ózd; János Sziklavári, Budapest, all of Hungary

[73] Assignee: Vasipari Kutato es Fejleszto Vallalat, Budapest, Hungary

[21] Appl. No.: 760,991

[22] Filed: Jul. 31, 1985

[30] Foreign Application Priority Data

Aug. 1, 1984 [HU] Hungary ..... 2934/84

[51] Int. Cl.[4] ..... C21C 7/00

[52] U.S. Cl. ..... 75/59.13; 75/59.12; 75/59.29

[58] Field of Search ..... 75/59.13, 59.12, 59.29

[56] References Cited

U.S. PATENT DOCUMENTS

| | | | |
|---|---|---|---|
| 3,140,168 | 7/1964 | Halley | 75/26 |
| 4,427,183 | 1/1984 | Hegemann | 75/59.13 |
| 4,474,361 | 10/1984 | Kanemoto | 75/59.13 |

*Primary Examiner*—Peter D. Rosenberg

*Attorney, Agent, or Firm*—Karl F. Ross; Herbert Dubno

[57] ABSTRACT

The invention relates to a process for the removal of contaminating chemical elements from pig-iron, steel and other metals and metal alloys in course of the refining process with oxygen blast, as well as for accelerating hydrometallurgical processes.

The essence of the process lies in that quantity of free oxygen radicals and temperature of smelting bath are controlled.

7 Claims, No Drawings

PROCESS FOR THE REMOVAL OF CONTAMINATING ELEMENTS FROM PIG-IRON, STEEL, OTHER METALS AND METAL ALLOYS

The invention relates to a process for the removal of contaminating chemical elements from pig-iron, steel, other metals and metal alloys in the course of refining processes with an oxygen blast, as well as for accelerating hydrometallurgic processes.

It is a well known fact that according to presently used definitions all iron alloys containing carbon in the range between 0 and 2% have been called steels. Steel has been produced from pig-iron, iron scrap, using the Bessemer-Thomas and Siemens-Martin processes, respectively, or recently by bessemerizing with oxygen. In the course of steel producing technology liquid iron-pig or solid charge is melted. Superfluous carbon, contaminants, sulfur, phosphorus and alloying elements contained in the charge are burnt in the so-called refining period or transferred to the slag.

It is also known that as a further-development of steel production in Bessemer-Thomas converters in 1952 to so-called LD steel processing method was developed, being productive in large volume and yielding products of good quality. In comparison to known processes the advantage of the so-called LD-process lies in that in order to remove impurities of the iron-pig, oxygen of high purity is blown onto the smelting bath with a velocity exceeding the velocity of sound, as a result, a product of especially good quality and of high purity can be obtained.

Further technical developments include several versions of the LD-process.

Out from the further developed versions of the LD-process processes LWS, OBM (Q-BOB), QEK, AOD, etc. are the most known, as well as the so-called KORF-process which got known at the beginning of the eighties; by using said process it became possible to blow in oxygen directly into the steel bath below the slag-phase in course of steel production, i.e. refining in low hearth (Martin-process). The KORF-process is described in the German Patent DE-PS 2 946 030.

However, the aforementioned modern steel-producing processes in themselves could not ensure mass production of steels of high purity, excellent quality and characteristics, production could be realized only with processes using expensive equipment, e.g. processes with electroslag, vacuum-arc, plasma beam i.e. with vacuum-equipment.

In the practice of producing steel, other metals and metal alloys it is well known, that certain material characteristics are related to the corresponding crystal structures and lattice structures. It is also well known, that certain crystal structures and lattices, respectively, are produced by introducing alloying elements i.e. by removing impurities. In such a manner it will be quite obvious that certain products showing certain material characteristics can be produced either by introducing alloying element or by removing impurities.

The object of our invention is to eliminate said deficiencies, i.e. to develop a process for the mass production of metallurgic products of high purity, which can be characterized with a far better efficiency, than previously known processes.

The task set for our invention is to develop a process for the removal of chemical impurities from pig-iron, steel or any other metals or metal alloys, as well as for accelerating hydrometallurgic processes.

The invention is based on the recognition, in so far as the task set can be solved for the process having been mentioned in the preamble, if quantity of chemical impurities is reduced by a chemical reaction and hydrometallurgic processes are accelerated.

In accordance with the invention the task set was solved in such a manner that quantity of free oxygen radicals in the smelting bath and temperature of the smelting bath are controlled.

From the point of view of a simplified technology the embodiment is also considered as advantageous, with which the temperature of the smelting bath is controlled by introducing carbon dioxide.

In order to increase productivity it is recommended to use an ozoniferous gas mixture containing 0.1 to 15 vol.% ozone for ozonization.

Advantegously ozone is produced from oxygen and/or air and/or carbon dioxide.

Further on the task set was solved according to the invention in such a manner that introduction of the ozoniferous gas mixture is begun in the period of smelting.

Versions of the process according to the invention will be described in detail by specifying the process for producing pig-iron, steel and other metals and metal alloys.

By applying the process according to the invention, based on experimental results and practical experiences we arrived at the conclusion that by using ozone gas, contaminating elements, e.g. carbon, silicon, phosphorus, sulfur etc. can be easily and quickly removed from the metal melt, i.e. oxidized.

The explanation of said phenomenon lies in that ozone ($O_3$) is decomposed in the metal melt to atomic oxygen (oxygen nascens), as a consequence the velocity of reaction with the single accompanying elements of contaminating character will be higher, than with $O_2$ with a double-bond (molecular oxygen).

For producing the ozone needed for the process according to the invention several solutions are known. Out of the known processes those are the most suitable ones for metallurgic purposes which are based on ozone production from oxygen and/or carbon dioxide. For producing ozone from air we applied ozonizers of industrial size, used mainly for drinking water purification. The capacity of said equipment lies in the range between 20 and 30 kg/h.

Storage and delivery of ozone used for the process according to the invention is to be carried out in special means complying with the prescriptions and demands of the authorities and in the prescribed way, as concentration exceeds 16 mole-%, simultaneously significant explosion danger involved in the application of ozone has to be considered too.

Application of ozone in metallurgy has been inhibited by the considerable explosion danger, irregulability of reaction velocity and low level of technical development of the equipments and armatures for ozone blasting.

In course of the process according to the invention ozone content of oxygen is adjusted so, that in course of use it should be kept under the critical value of explosion, i.e. it should not be more, than 15 vol.%.

In dependence of particular possibilities of application of the process according to the invention into the ozonizer technological oxygen and/or carbon dioxide and/or air is (are) introduced as the basic material of ozone production. Ozone content of the gas mixture can be controlled in a manner known per se.

In dependence of particular application of the process according to the invention, the gas mixture having been prepared in compliance with metallurgic technology and the quality of the metal wanted to be produced—in which quantity of ozone may lie in the range between 0.1 and 15 vol.%—is blasted into metal melt under the slag level, while duration of blasting and vol.% of ozone can be changed in dependence of the product quality and design of the equipment.

Let us mention some examples of field of application for solving the task as specified in the preamble.

In the course of pig-iron production in order to increase temperature of the hearth of the blast furnace and to increase reaction velocity the oxygen is enriched with ozone in a proper proportion, while temperature of the blast furnace is controlled in such a manner that $CO_2$-gas inducing an endotherm process is admixed to oxygen in the proper proportion.

In existing equipment for pig-iron treatment, so e.g. in different desulfurizing equipments, etc. by taking the necessary measures for flue gas outlet and in respect to labor protection and ecology ozoniferous gas mixture can be successfully applied for predecarbonization, desilicization, desulfurization etc. of pig-iron, either with upper, lower or combined blasting of $CO_2$-gas as a temperature regulating gas.

In course of steel production, taking place in LD or other converters, or Siemens-Martin furnaces operated with the KORF-process, steel-up to a carbon content of 0,2 to 0,3%—is defined with $O_2$ in the usual manner, thereafter a gas mixture containing also the proper quantity of ozone is blown into the steel bath up to the production of steel of the desired composition.

In order to shorten the period of oxygen blasting, a gas mixture containing a smaller quantity of ozone is blown into the steel bath, beginning from the decantation of pig-iron, when operating in Siemens-Martin furnaces with the KORF-process. With the same purpose gas mixture also containing ozone is used with the KORF-process beginning from decantation of the pig-iron.

In case of the double-KORF-process blast of ozoniferous gas mixture can be solved even with a higher efficiency.

Ozone blast can be successfully applied in cases when we intend to increase ratio of cold charge in steel manufacturing furnaces. In this cases ozoniferious gas mixture is blown-in already in course of smelting.

Blasting ozoniferous gas mixture can be successfully applied (a) in pig-iron and steel production for foundries, (b) metallurgy of colored metals and rare-metals, (c) as well as in hydrometallurgy.

Process according to the invention was realized so, that oxygen having been enriched with ozone was blown into the metal bath, directly under the slug by means of a lance or nozzles arranged on the bottom or laterally. It also becomes possible to use repeatedly the gas mixture containing ozone and/or other gases in the closed system after having it cleaned after blasting.

The advantage of the process according to the invention lies in that oxidizing i.e. removal of impurities of low concentration dissolved in the metal results in the most simple, quick and economical production of metallurgical products of excellent quality.

A further advantageous feature of the process according to the invention lies in that in addition to cooling of the nozzles temperature of the metal bath can be controlled by means of $CO_2$-gas inducing an endotherm process.

What we claim:

1. A process for the removal of contaminating chemical elements from pig iron, steel, and other metals, as well as metal alloys, in the course of refining processes with an oxygen blast, which comprises the step of controlling the quantity of free oxygen radicals and temperature of the smelting bath by introducing ozone or carbon dioxide.

2. The process defined in claim 1 wherein the quantity of free oxygen radicals and the temperature of the smelting bath is carried out by using a gas mixture with an ozone content of 0.1 to 15 vol.%.

3. The process defined in claim 1 wherein the ozone is produced by employing oxygen, air, carbon dioxide or mixtures thereof.

4. The process defined in claim 1 wherein the introduction of the ozone is begun during the smelting.

5. A method for accelerating a hydrometallurgical process which comprises the step of controlling the quantity of free oxygen radicals and temperature by introducing ozone or carbon dioxide.

6. The process defined in claim 5 wherein the quantity of the free oxygen radicals and the temperature are controlled by using a gas mixture with an ozone content of 0.1 to 15 vol.%.

7. The process defined in claim 5 wherein the ozone is produced by employing oxygen, air, carbon dioxide, or mixtures thereof.

* * * * *